US005172401A

United States Patent [19]

Asari et al.

[11] Patent Number: 5,172,401

[45] Date of Patent: Dec. 15, 1992

[54] HIGH-SPEED SCAN TYPE X-RAY GENERATOR

[75] Inventors: Masatoshi Asari, Uji; Shiro Oikawa, Shiga, both of Japan

[73] Assignee: Shimadzu Corporation, Kyoto, Japan

[21] Appl. No.: 692,849

[22] Filed: Apr. 29, 1991

[30] Foreign Application Priority Data

Apr. 30, 1990 [JP] Japan ..... 2-114004
May 22, 1990 [JP] Japan ..... 2-132082
May 31, 1990 [JP] Japan ..... 2-144040

[51] Int. Cl.[5] ..... H05G 1/60

[52] U.S. Cl. ..... 378/10; 378/137; 378/4

[58] Field of Search ..... 378/10, 137, 4

[56] References Cited

U.S. PATENT DOCUMENTS 4,300,051 11/1981 Little ..... 378/137
4,392,235 7/1983 Houston .
4,531,226 7/1985 Peschmann .
4,631,741 12/1986 Rand et al. .
4,631,743 12/1986 Tomimasu et al. .

FOREIGN PATENT DOCUMENTS 2729353 1/1979 Fed. Rep. of Germany .
0110734 12/1985 France .
6168032 8/1986 Japan ..... 378/10
2044985 10/1980 United Kingdom .

*Primary Examiner*—Craig E. Church
*Attorney, Agent, or Firm*—Nikaido, Marmelstein, Murray & Oram

[57] ABSTRACT

A high-speed scan type X-ray generating apparatus for scanning X-ray generating positions along a circumference of an examinee, in which an electron beam is emitted from an electron gun into a ring-shaped vacuum tube. The electron beam is deflected by electromagnets or the like to run on a circular orbit through the vacuum tube. The electron beam is further deflected by different, small electromagnets to deviate from the circular orbit and impinge on a ring-shaped target, thereby generating an X-ray toward the center of the vacuum tube. By controlling the small electromagnets, the X-ray generating position is caused to scan at high speed along a circumferential wall of the ring-shaped target.

5 Claims, 14 Drawing Sheets

HIGH-SPEED SCAN TYPE X-RAY GENERATOR

BACKGROUND OF THE INVENTION (1) Field of the Invention

This invention relates to a high-speed scan type X-ray generator suited for use with an X-ray CT apparatus, which is capable of a high-speed scan of X-ray emitting positions circumferentially arranged around an examinee.

(2) Description of the Related Art

The X-ray CT apparatus is typically used to obtain images of X-ray absorptivity distribution in cross sections of an examinee by emitting X-rays from varied directions through 360 degrees (or 180 degrees) around the examinee, and subjecting the multi-directional X-ray transmission data which is thereby collected to image regeneration processing. In order to collect multi-directional X-ray transmission data, the X-ray CT apparatus usually has an X-ray tube rotatable by a rotating mechanism to emit X-rays from varied directions around an examinee.

With the rotation of the X-ray tube itself, however, data cannot be collected quickly since it takes about one second for the X-ray tube to make one complete rotation or a half rotation to obtain a single slice image. The above photographic method is therefor not fit for examination of an organ such as the heart whose movement can be captured only with high-speed imaging in the order of 30 frames per second.

In view of the above drawback, an X-ray generator has been proposed in recent years, which is capable of running an X-ray generating position on a circumference at a very high speed. This known high-speed scan type X-ray generator will be described hereunder with reference to FIG. 1. The generator comprises a bell-shaped vacuum tube 1, and an electron gun 2 connected to a proximal end of the vacuum tube 1. The vacuum tube 1 contains deflecting coils 3, deflecting electrodes 4, and a ring-shaped target 5. An electron beam 6 emitted from the electron gun 2 is deflected by the deflecting coils 3 and deflecting electrodes 4 to impinge on the target 5. As a result, an X-ray 7 is emitted from the target 5 toward a central part of the vacuum tube 1. By controlling the deflecting coils 3 and deflecting electrodes 4, an X-ray generating position (focal point) 8 is caused to run at high speed along the circumferential wall of the target 5. Consequently, the X-ray 7 is emitted from varied directions around an examinee M, who is introduced into the central part of the vacuum tube 1. In this way, a picture for one frame can be picked up, for example in about 50 msec.

With this known high-speed scan type X-ray generator, however, the electron beam 6 is run in the direction perpendicular to a plane formed by the ring-shaped target 5 or by the circumference on which the X-ray generating position 8 moves, and the electron beam 6 is deflected in the course of its run. Consequently, the X-ray generator must have a very large size, about 4 meters long in the direction perpendicular to the plane formed by the ring-shaped target 5 (i.e. axially of the examinee M). Therefore, an X-ray CT apparatus using such an X-ray generator requires a large installation space.

SUMMARY OF THE INVENTION

This invention has been made with regard to the state of the art noted above, and its main object is to provide a high-speed scan type X-ray generator of compact construction having a reduced length axially of an examinee.

Other objects of this invention will be apparent from the following description.

The above and other objects are fulfilled, according to this invention, by a high-speed scan type X-ray generating apparatus for scanning X-ray generating positions along a circumference of an examinee, comprising a ring-shaped vacuum tube, an electron gun for emitting an accelerated electron beam into the vacuum tube, a first deflecting device for causing the electron beam to run on a ring-shaped orbit through the vacuum tube, a second deflecting device for causing the electron beam to deviate from the ring-shaped orbit, and a target for generating X-rays toward center of the vacuum tube when the electron beam deviating from the ring-shaped orbit impinges thereon.

The electron beam may be emitted into the ring-shaped vacuum tube from one or more electron guns. The electron beam emitted from the electron gun can, for example, enter the ring-shaped vacuum tube tangentially of the ring-shaped orbit in the vacuum tube. Where the electron beam enters the vacuum tube in a direction intersecting the ring-shaped orbit, an additional deflecting device is used to put the electron beam in the ring-shaped orbit.

The first deflecting device may be formed of magnets or electrodes. Where magnets are used, a pair of ring-shaped magnets may be opposed to each other across the vacuum tube for generating a magnetic field perpendicular to a plane formed by the ring-shaped vacuum tube. These magnets may be electromagnets or permanent magnets. The electron beam entering the vacuum tube moves into the circular orbit by the action of the magnetic field formed by these magnets.

The electron beam may be converged radially of the circular orbit by means of pole faces of the pair of opposite magnets inclined to diverge from each other as they extend toward the center of the vacuum tube. Where the two pole faces of the magnets are inclined as above, the lines of magnetic force formed between the pole faces become curved, tending to disperse the electron beam in a direction perpendicular to the plane formed by the circular orbit. It is therefore desirable to converge the electron beam in the direction perpendicular to the plane formed by the circular orbit. This may be achieved by forming hills and valleys on the inclined pole faces to alternate high and low flux densities, or by alternately reversing polarity of magnetic poles, in the direction of travel of the electron beam. In this case, a mean magnetic field formed must cause the electrons to describe a circular orbit.

The second deflecting device is formed, for example, of at least one pair of small electromagnets disposed in spaces between the opposite pole faces of the magnets acting as the first deflecting device and the vacuum tube, for generating a magnetic field opposite to the magnetic field formed by the magnets. The magnetic field formed by the small electromagnet causes the electron beam to deviate radially outwardly from the ring-shaped orbit. Where the target is a ring-shaped target having an inside peripheral wall on which the electron beam impinges, after having deviated radially outwardly of the circular orbit, the X-rays travel toward the center of the ring-shaped vacuum tube. Where the second deflecting device is formed of a single small electromagnet, the X-ray generating position may be caused to scan the inside peripheral wall of the target at high speed by controlling the value of current supplied to the small electromagnet. Where the second deflecting device includes a plurality of small electromagnets, the X-ray generating position may be caused to scan the inside peripheral wall of the target at high speed by successively switching the small electromagnets on and off.

The second deflecting device may have a different construction such as including at least one pair of small electromagnets opposed to one another across and radially of the vacuum tube. In this case, a magnetic field opposite to the magnetic field formed by the magnets is formed to cause the electron beam to deviate in a direction intersecting the plane formed by the vacuum tube. The target used in this case is a ring-shaped target having a wedge-shaped section for generating the X-rays toward the center of the vacuum tube when the electron beam deviating from the circular orbit impinges thereon.

Further, the second deflecting device may be formed of a ring-shaped fixed cathode and a ring-shaped grid mounted inside the ring-shaped vacuum tube. The target in this case is a ring-shaped target opposed to the fixed cathode across the grid. By varying the voltage applied to the grid, the X-ray generating position may be caused to scan the circumferential wall of the target at high speed.

According to this invention, as described above, X-rays may be emitted from various positions in the ring-shaped vacuum tube, and the X-ray generating position may be caused to scan at high speed. The compact construction provided by this invention has a great advantage with regard to installation space.

BRIEF DESCRIPTION OF THE DRAWINGS

For the purpose of illustrating the invention, there are shown in the drawings several forms which are presently preferred, it being understood, however, that the invention is not limited to the precise arrangements and instrumentalities shown.

DESCRIPTION OF THE PREFERRED EMBODIMENTS

Preferred embodiments of this invention will be described in detail hereinafter with reference to the drawings.

FIRST EMBODIMENT

Figure 1:
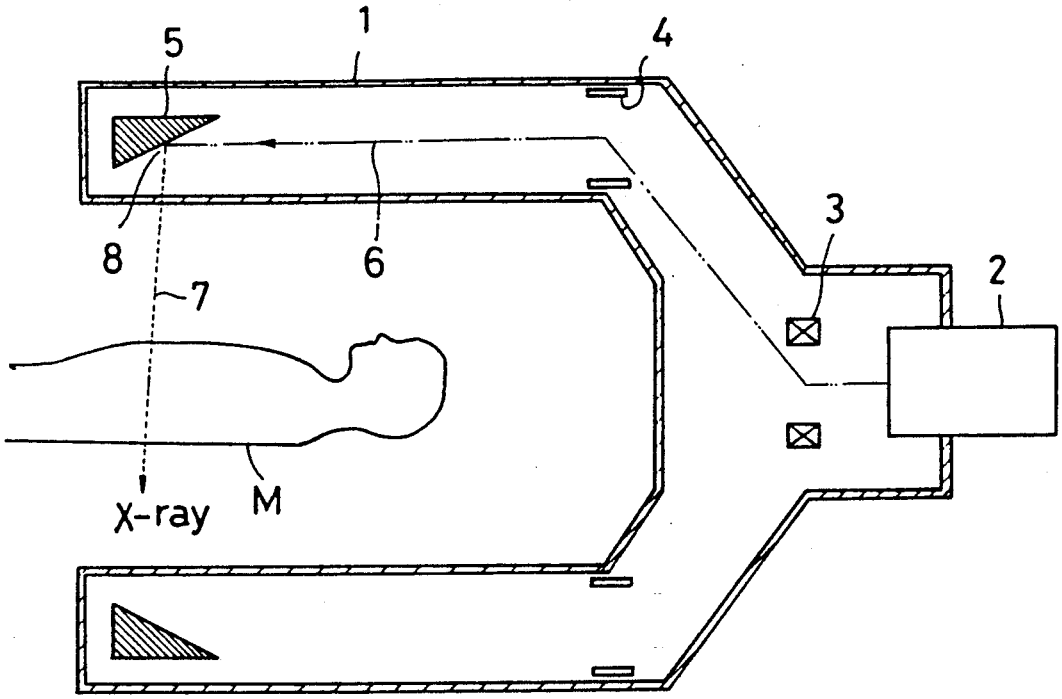
Fig.1 (Prior Art)
FIG. 1 is a view in vertical section showing an outline of a conventional high-speed scan type X-ray generator.
Figure 2:
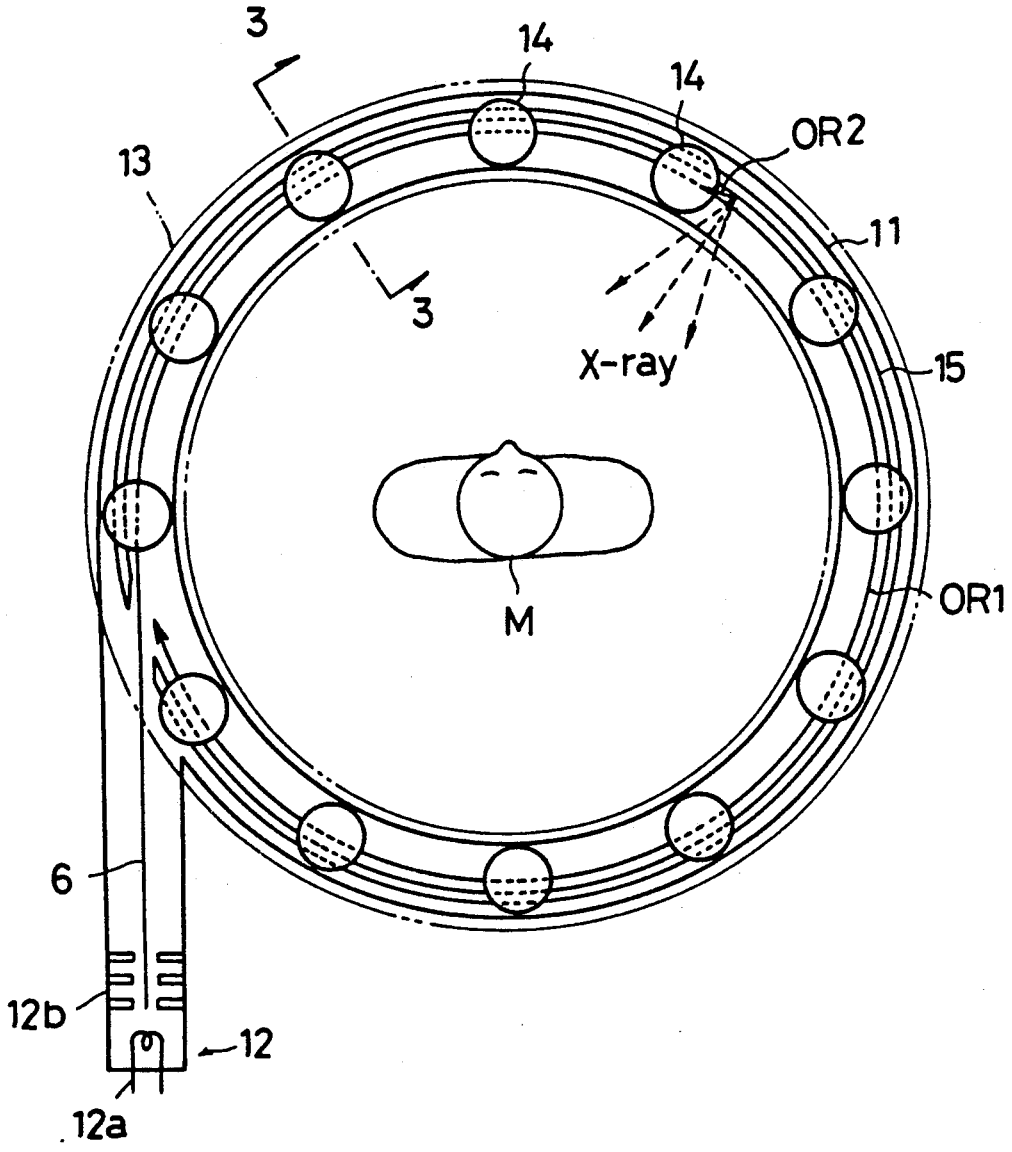
FIG. 2 is a plan view of an apparatus in a first embodiment of this invention.
Figure 3:
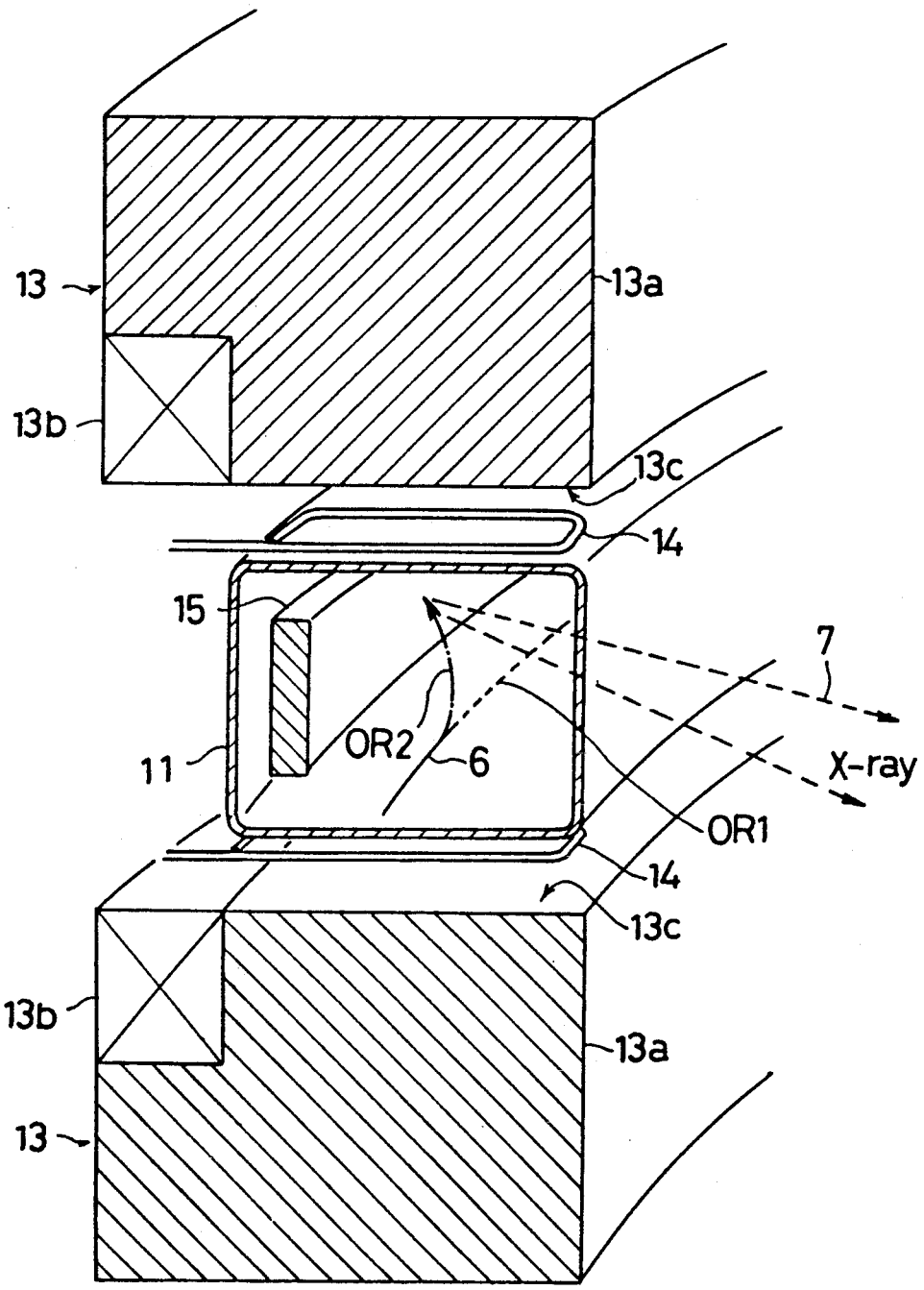
FIG. 3 is a cut away section taken on line A—A of FIG. 2.

FIG. 2 is a plan view of a high-speed scan type X-ray generator according to a first embodiment of the invention. FIG. 3 is a section taken on line A—A of FIG. 2.

This high-speed scan type X-ray generator includes a ring-shaped vacuum tube 11 defining a hollow space in the center thereof for receiving an examinee M. An electron gun 12 is connected to the vacuum tube 11, which includes a filament 12*a* for emitting an electron beam 6, and accelerating electrodes 12*b* for accelerating the electron beam 6 prior to entry to the vacuum tube 11. In order to cause the incident electron beam 6 to run along a circular orbit OR1 as shown in FIG. 2, two ring-shaped electromagnets 13 are arranged opposite upper and lower surfaces of the vacuum tube 11, respectively, as shown in FIG. 3. Each of the electromagnets 13 includes a ring-shaped core 13*a* and a coil 13*b* wound thereon. These electromagnets 13 correspond to a first deflecting device of this invention. A uniform magnetic field is formed between these electromagnets 13 in a direction perpendicular to a plane formed by the ring-shaped vacuum tube 11, i.e. in a direction from the upper electromagnet 13 to the lower electromagnet 13. Assuming, for example, that the electrons have an energy of 100 keV and the circular orbit OR1 has a diameter about 0.6 m, the pair of electromagnets 13 may form a magnetic field of about 37 gauss therebetween.

Small electromagnets 14 are disposed in spaces between the electromagnets 13 and vacuum tube 11, in pairs opposed to one another across the vacuum tube 11. Such pairs of small electromagnets 14 are arranged equidistantly along the vacuum tube 11. These small electromagnets 14 constitute a second deflecting device of this invention. Each pair of opposed small electromagnets 14 forms a magnetic field having an opposite direction to the magnetic field formed by the ring-shaped electromagnets 13 (i.e. the direction from the lower small electromagnet 14 to the upper small electromagnet 14 in FIG. 3). The pairs of small electromagnets 14 arranged along the vacuum tube 11 are turned on and off individually.

When the small electromagnets 14 are off, the electron beam 6 entering the vacuum tube 11 moves along the circular orbit OR1. When a certain pair of the small electromagnet 14 is turned on, the magnetic field thereby formed applies a force to the electron beam 6, whereby the electron beam 6 deviates from the circular orbit OR1 to follow an orbit swerving outwardly of the circular orbit OR1 (i.e. an orbit OR2 in FIGS. 2 and 3).

The vacuum tube 11 contains a ring-shaped target 15 extending along an outward wall thereof. The above-mentioned orbit OR2 intersects the target 15, and therefore the electron beam 6 following the orbit OR2 impinges on the target 15. As a result, an X-ray is generated at a position of impingement to travel inwardly, i.e. toward the center, of the ring-shaped vacuum tube 11.

Thus, by turning on any one of the plural pairs of small electromagnets 14, the electron beam 6 may be caused to deviate from a selected position of the circular orbit OR1 for impingement on the target 15. By high-speed switching of the current for energizing the small electromagnets 14, the impinging position of electrons, i.e. X-ray generating position (focal point), may be shifted at high speed along the inside wall of the target 15. Fine control may be made of the X-ray generating position by arranging the small electromagnets 14 in high concentration along the ring-shaped vacuum tube 11.

Where the electron beam 6 is allowed to impinge on the target 15 at varied angles thereto, the position of the target 15 on which the electron beam 6 impinges may be controlled by adjusting the intensity of the magnetic fields formed by the small electromagnets 14. For controlling the X-ray generating position by means of the magnetic field intensity, the small electromagnets 14 may be reduced in number and a single pair of such magnets will serve the purpose.

Figure 4:
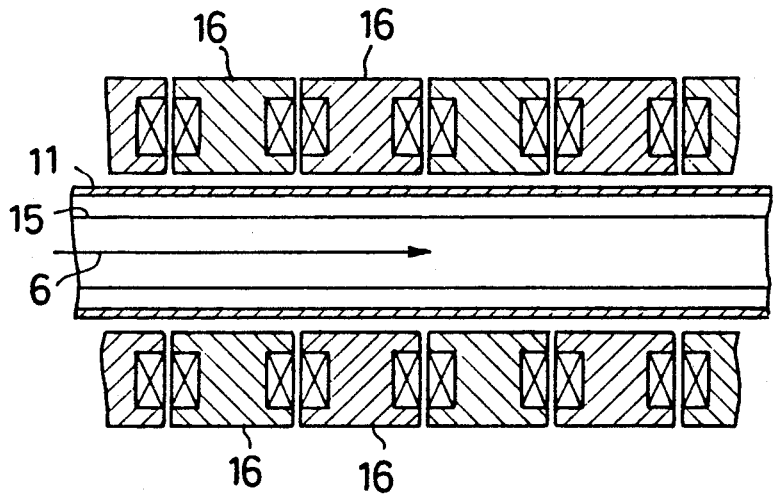
FIG. 4 is a sectional view showing modified first and second deflecting devices.

In the foregoing embodiment, plural pairs of small electromagnets 14 are provided to form the magnetic fields for orbit deviation. Alternatively, part of the magnetic field formed by the ring-shaped electromagnets 13 may be nullified, through which the electron beam 6 will depart tangentially from the circular orbit OR1 to impinge on the target 15. Thus, as shown in FIG. 4, divided electromagnets 16 may be arranged along the upper and lower surfaces of the vacuum tube 11. In this construction, the respective pairs of upper and lower electromagnets 16 are successively switched on and off, such that the magnetic fields are formed upstream and not downstream of a certain position with respect to a traveling direction of the electron beam 6. Consequently the X-ray generating position is caused to run at high speed along the inside wall of the target 15.

Figure 5:
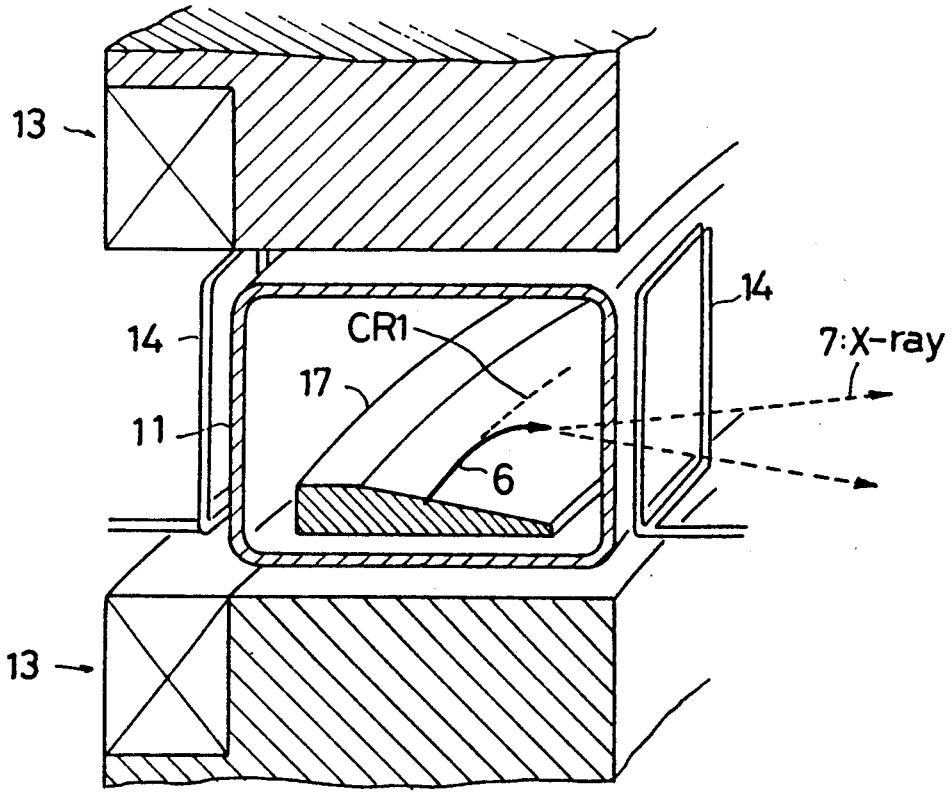
FIG. 5 is a sectional view showing another modified second deflecting device.

Further, in the foregoing embodiment, the X-ray generating ring-shaped target 15 is disposed outwardly of and concentrically with the circular orbit OR1 of the electron beam 6. The target 15 may be disposed either upwardly or downwardly inside the vacuum tube 11. As shown in FIG. 5, for example, a target 17 having a wedge-shaped section may be disposed downwardly inside the vacuum tube 11. In this case, the small electromagnets 14 are arranged along the inward wall and outward wall of the vacuum tube 11 to be opposed to one another across the vacuum tube 11. The small electromagnets 14 form magnetic fields from radially inwardly to outwardly of the vacuum tube 11 to direct the electron beam 6 to the target 17.

In the foregoing embodiment, the magnetic field formed by the ring-shaped electromagnets 13 is used to cause the electron beam 6 to run along the circular orbit OR1, and the magnetic fields formed by the small electromagnets 14 are used to cause the electron beam 6 to deviate from the circular orbit OR1. These electromagnets may be replaced with electrodes to effect a similar control by means of electric fields thereby formed.

The electron gun 12 may comprise the type that emits a beam of electrons continuously or the type that emits the beam intermittently. The electron gun 12 has a reduced load when emitting the electron beam intermittently.

The X-rays generated may be given variable energy by varying the electron beam accelerating energy while maintaining its correlation with the magnetic or electric field that causes the electron beam to run along the circular orbit OR1.

Figure 6:
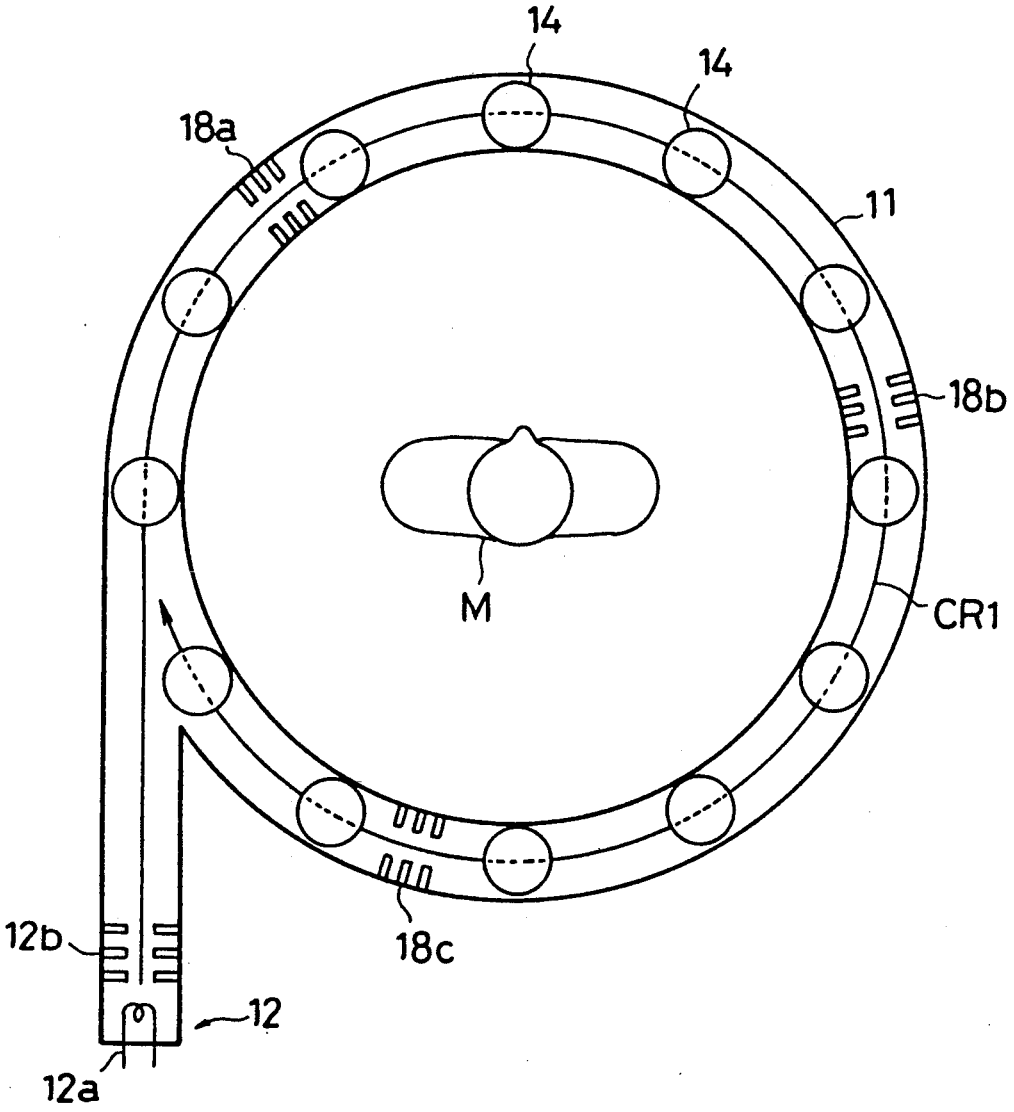
FIG. 6 is a plan view showing an example in which a vacuum tube includes a plurality of accelerating electrodes.

In the foregoing embodiment, the accelerating electrodes **12*b* are arranged only adjacent the filament 12*a*. As shown in FIG. 6, the ring-shaped vacuum tube 11 may include additional accelerating electrodes 18*a*–18*c* disposed at an appropriate position or positions thereof for re-accelerating the electron beam, thereby to compensate for energy loss of the electron beam. This construction allows the electron beam enclosed in the ring-shaped vacuum tube 11 to continue moving along the circular orbit OR1. The load of the electron gun 12** may thereby be reduced further.

The foregoing embodiment has been described as deflecting the electron beam to move along the circular orbit OR1. However, an elliptical or polygonal orbit of the electron beam is also conceivable. In the case of a polygonal orbit, magnets or electrodes are disposed adjacent the respective vertices to form magnetic or electric fields for deflecting the beam.

SECOND EMBODIMENT

A second embodiment of this invention will be described next.

With the high-speed scan type X-ray generator in the first embodiment, the electron beam tends to be dispersed radially of the circular orbit OR1 owing to non-uniformity or space charge effect of the magnetic field when large quantities of electrons impinge on parallel pole faces (referenced **13*c* in FIG. 3) of the pair of ring-shaped electromagnets 13**. When the electron beam is dispersed, the focal point of the X-ray is enlarged to deteriorate quality of the images picked up by X-ray CT. This second embodiment provides an improvement for eliminating this drawback of the first embodiment as explained below.

Figure 7:
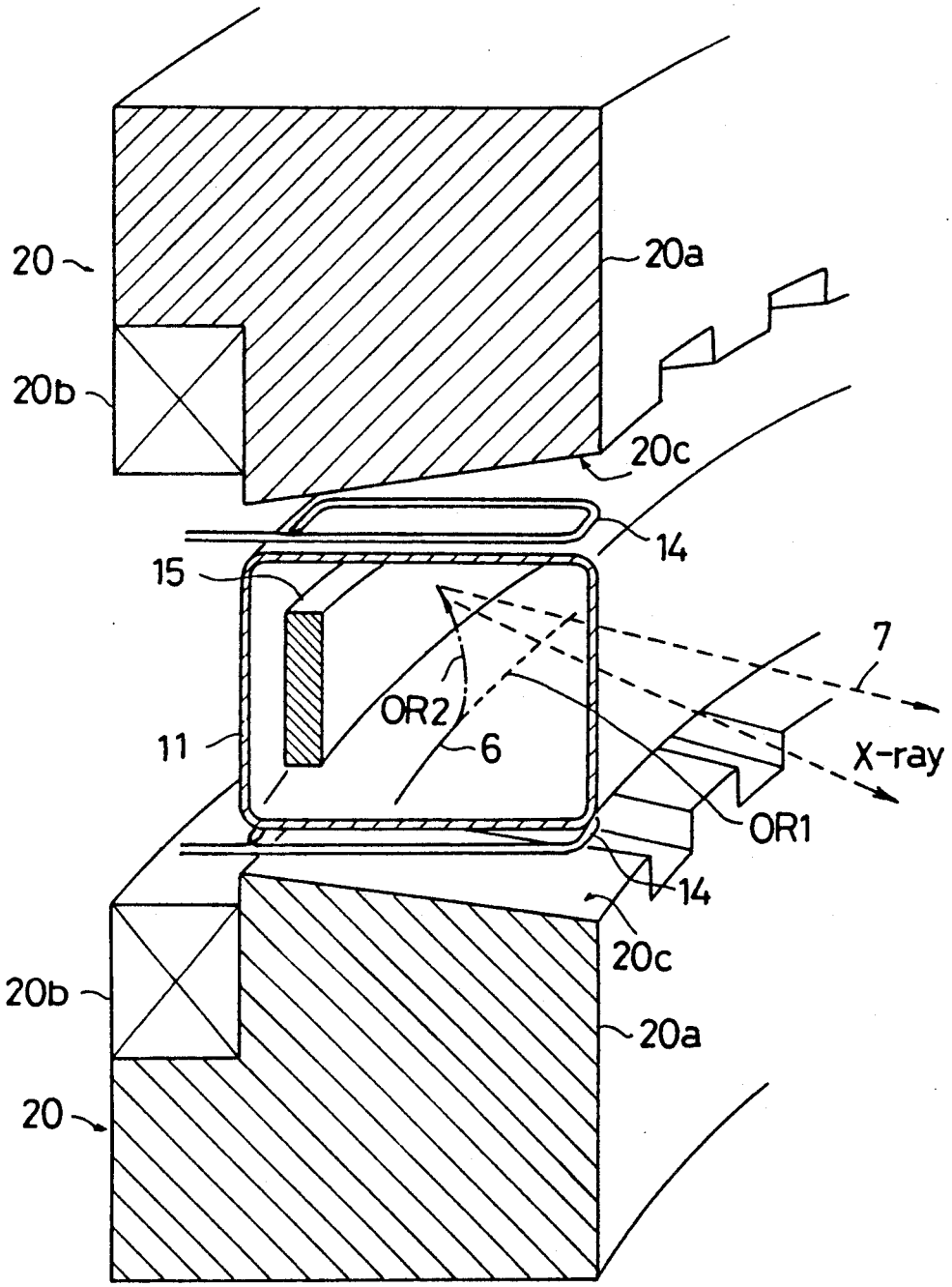
FIG. 7 is a sectional view showing a principal portion of an apparatus in a second embodiment of this invention.

FIG. 7 is a sectional view corresponding to FIG. 3 of the first embodiment. In FIG. 7, like reference numerals are used to identify like parts in FIG. 3 which are the same as in the first embodiment, and therefore will not be described again.

As shown in FIG. 7, the characterizing feature of this embodiment lies in electromagnets 20 arranged opposite the upper and lower surfaces of the vacuum tube 11. Each of these electromagnets 20 includes a core **20*a* defining an outwardly projecting flange, and a coil 20*b* wound around the core 20*a*. The cores 20*a* define opposed pole faces 20*c*** which are inclined to diverge from each other as they extend toward the center of the ring.

Figure 8:
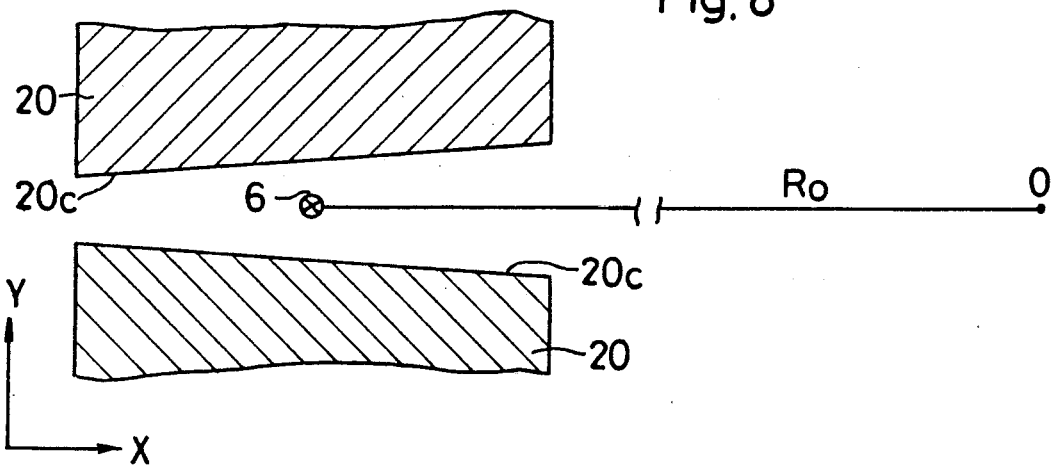
FIGS. 8 through 10 are views illustrating functions of the second embodiment.

Reference is now made to FIG. 8 for illustrating the way in which the electron beam runs through the magnetic flux formed between the opposed pole faces **20*c* of the electromagnets 20. The electron beam 6, which enters the magnetic flux formed between the pole faces 20*c*, is subjected to the force of the flux acting perpendicular to the running direction of the electron beam 6 and to the direction of the flux (that is, in FIG. 8, rightward on the assumption that the electron beam 6 runs at right angles to the sheet of drawings from front to back). As a result, the electron beam 6 runs on a circular orbit having a radius Ro. That is, the electron beam 6** receives Lorentz's force F1 expressed by the following equation:

$$F1 = evB$$

where e is an electric charge of the electrons, v is a velocity thereof, and B is a flux density. On the other hand, the centripetal force F2 of the electrons running on this circular orbit is expressed by the following equation:

$$F2=mv^2/R$$

where m is the mass of the electrons and R is the radius of the circular orbit. With these forces in equilibrium, i.e.

$$F1=F2,$$

and with the flux density B, the electrons are caused to run on the circular orbit having radius R. Thus, $$evB=mv^2/R.$$

Therefore, $$BR=mv/e.$$

The right side of the equation takes a fixed value unless the kinetic energy ($mv^2/2$) of the electrons changes. Thus, the orbit radius R is fixed if the flux density is fixed.

If the flux density B at the position of radius Ro shown in FIG. 8 is;

$$BRo=C \text{ (constant)},$$

the flux density becomes less ($B-\Delta B$) in the regions closer to the center O since the pole faces 20*c* are wider apart from each other. Consequently, for the electrons passing through the regions inwardly of the position of radius Ro, $$R=C/(B-\Delta B)>Ro,$$

and the electrons move outwardly away from the center O. Conversely, for the electrons passing through the regions outwardly of the position of radius Ro, $$R=C/(B+\Delta B)<Ro,$$

and the electrons move inwardly toward the center O. As a result, the electron beam 6 converges to the position of radius Ro.

Figure 9:
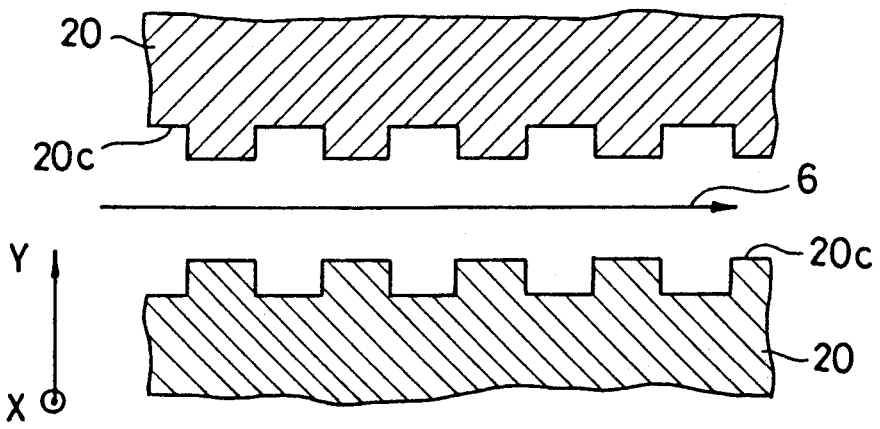
Figure 10:
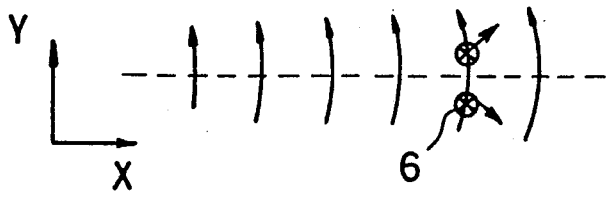

As shown in FIG. 9, the pole faces 20*c* define hills and valleys arranged in opposed relations in the running direction of the electron beam 6, i.e. circumferential direction. Consequently, the pole faces 20*c* alternate between being close to and being remote from each other. Since the pole faces 20*c* diverge from each other as they extend inwardly, the lines of magnetic force become curved as shown in FIG. 10, thereby generating forces to disperse, in the direction of arrow Y, the electrons that are out of a plane (shown in a broken line in FIG. 10) midway between the pole faces 20*c*. The above structure is employed to suppress such dispersion of the electrons. The hills and valleys formed on the pole faces 20*c* provide narrow regions having an increased flux density (B+B1) and broad regions having a decreased flux density (B−B1), which alternate n times in one circle (360 degrees). This structure has the effect, based on the principle of cyclotron strong convergence, of converging the electron beam 6 in the Y direction with running of the electron beam 6.

Figure 11:
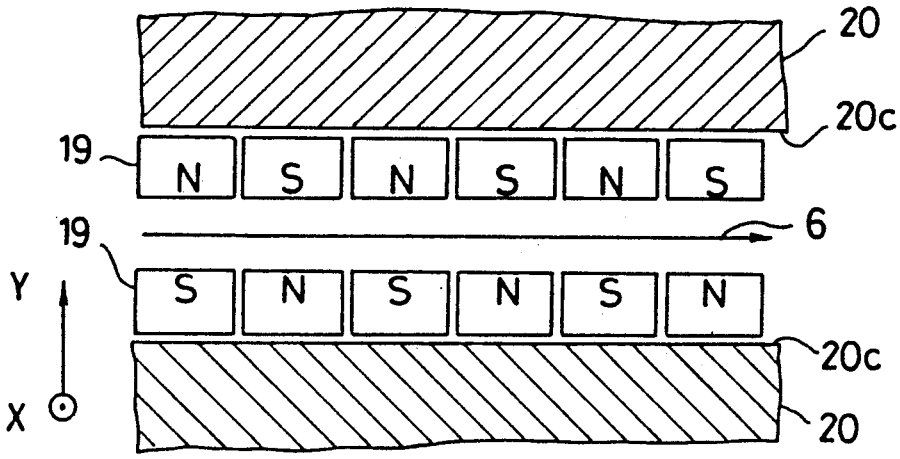
FIGS. 11 and 12 are explanatory views of a modification of the second embodiment.
Figure 12:
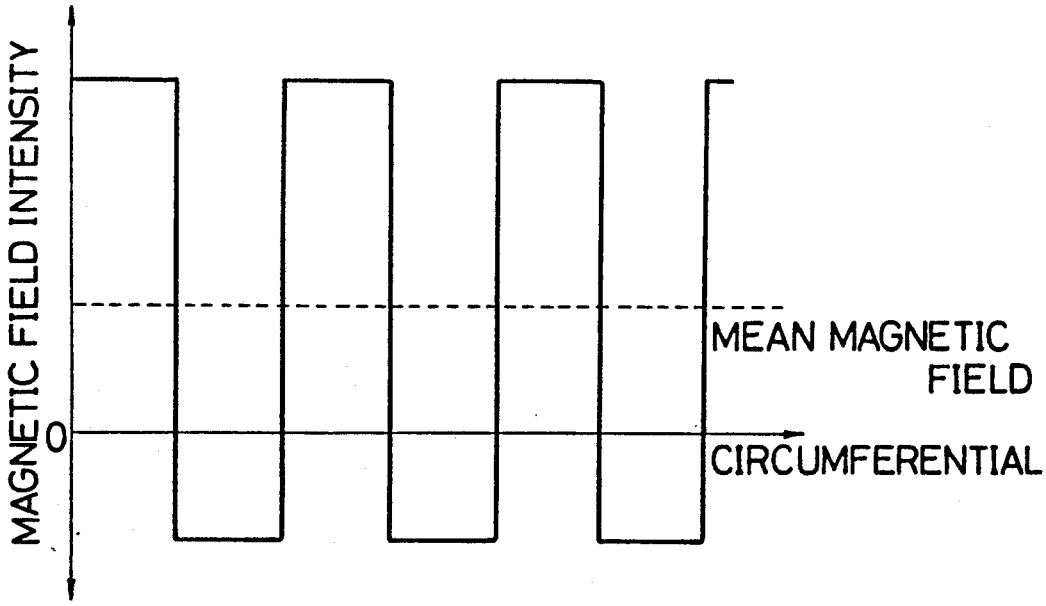

Apart from the hills and valleys formed on the pole faces 20*c*, dispersion in the Y direction of the electron beam 6 may be suppressed also by the following structure. As shown in FIG. 11, a plurality of magnets 19 with magnetic poles reversing alternately in the circumferential direction are arranged in the spaces between the ring-shaped vacuum tube 11 and the electromagnets 20 defining opposite pole faces 20*c* inclined to diverge from each other as they extend toward the ring center. These magnets 19 may be electromagnets or permanent magnets. FIG. 12 illustrates magnetic fields formed by the electromagnets 20 and magnets 19. The dispersion in the Y direction of the electron beam 6 may also be suppressed by the alternate reversal of polarity in the circumferential direction. It is necessary, however, to set a mean magnetic field between the pole faces 20*c* to an intensity which will cause the electrons to describe a circular orbit.

As described above, the electron beam 6 may be converged by providing the electromagnets 20 opposed to each other across the vacuum tube 11 to form a magnetic field for causing the electron beam 6 to move along a circular orbit, and appropriately shaping the pole faces 20*c* or alternately reversing the magnetic polarity.

When transmitting a large amount of electrons in acceleration as noted above, the electron beam 6 usually becomes dispersed out of a fixed track owing to nonuniformity of the magnetic field, space charge effect or other factors. It is therefore difficult to obtain a beam of a large amount of electrons; the beam must be converged by forming additional electric or magnetic fields. This would result in a large and complicated construction of the apparatus. However, a small and simple apparatus may be realized at low manufacturing cost by appropriately shaping the pole faces 20*c* of the electromagnets 20 or alternately reversing magnetic polarity.

The function of the small electromagnets 14 to cause the electron beam 6 entering the vacuum tube 11 to deviate from the circular orbit OR1 and collide with the target 15 is the same as in the first embodiment, and therefore is not described again.

THIRD EMBODIMENT

Figure 13:
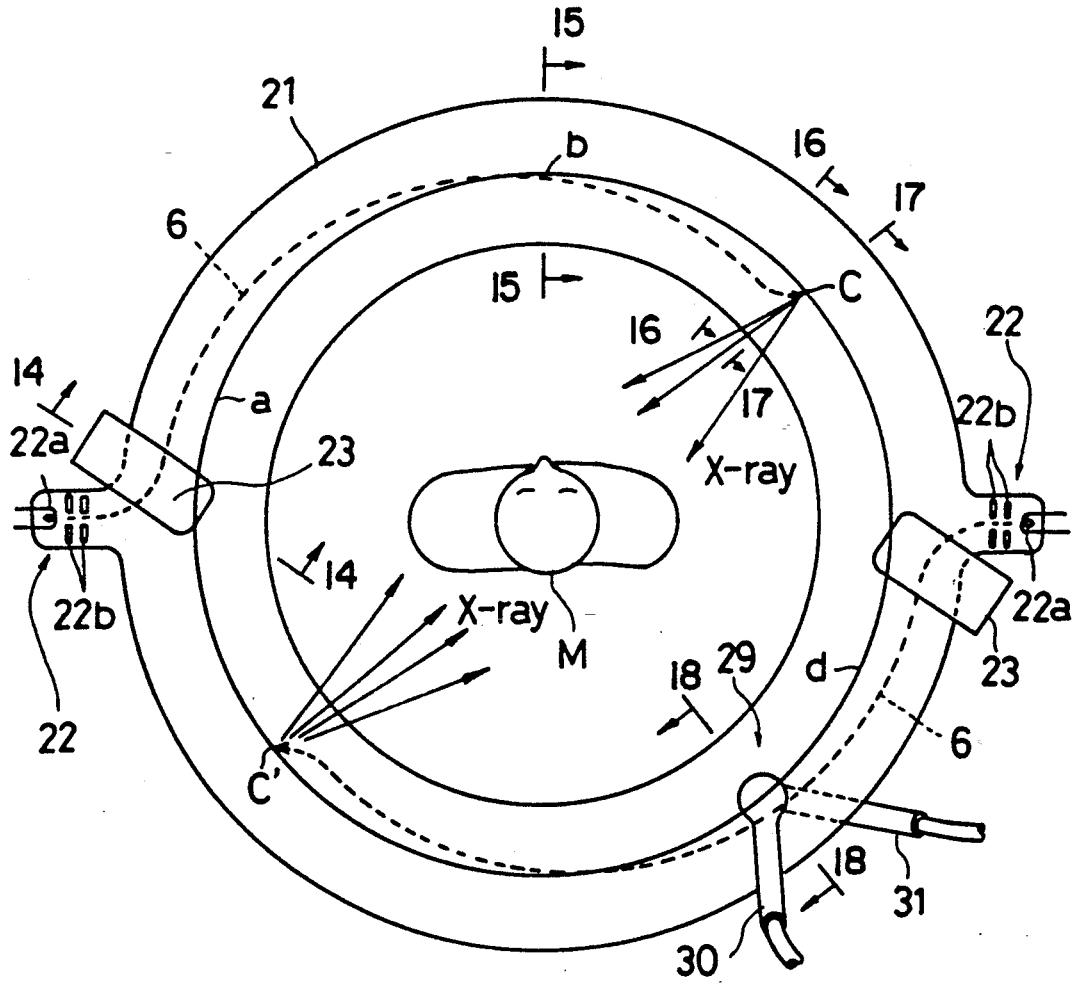
FIG. 13 is a plan view of an apparatus in a third embodiment.

FIG. 13 is a plan view showing an outline of a third embodiment of this invention.

This X-ray generator comprises a ring-shaped vacuum tube 21 defining a hollow space in the center for receiving an examinee M, as in the first embodiment. Two electron guns 22 are connected to the vacuum tube 11. Each of the electron guns 22 includes a filament 22*a* for emitting an electron beam 6, and accelerating electrodes 22*b* for accelerating the electron beam 6.

Figure 14:
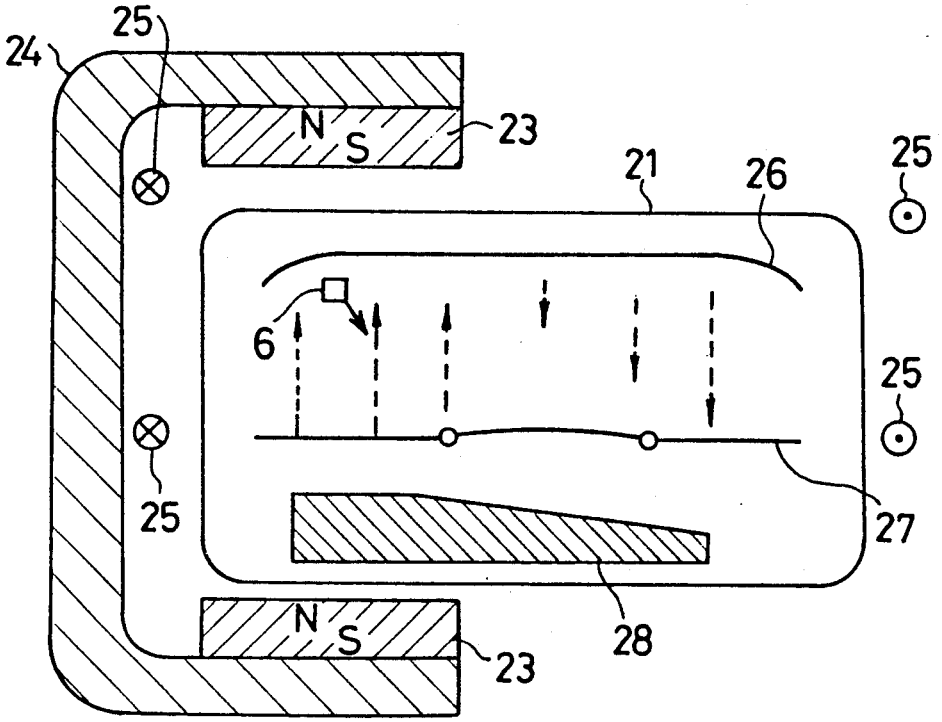
FIG. 14 is a section taken on line B—B of FIG. 13.
Figure 15:
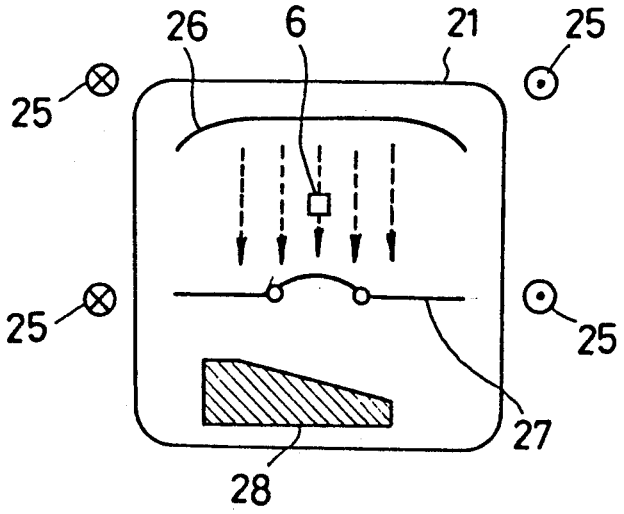
FIG. 15 is a section taken on line C—C of FIG. 13.
Figure 16:
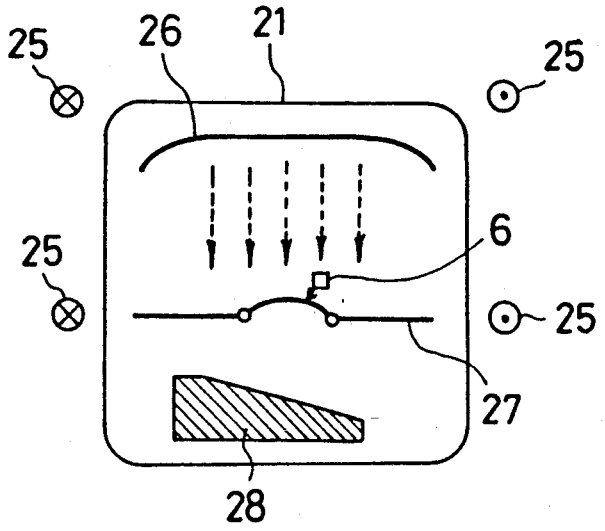
FIG. 16 is a section taken on line D—D of FIG. 13.

The accelerated electron beam 6 enters the vacuum tube 21, and, immediately upon entry, is deflected by a magnetic field function of deflecting magnets 23. These deflecting magnets 23 form a deflecting magnetic field to put the incident electron beam 6 in a circular orbit along the ring-shaped vacuum tube 21. As shown in FIG. 14, the deflecting magnets 23 are interconnected through a ferromagnetic yoke 24. The magnetic field formed by the deflecting magnets 23 (which magnetic field extends from back to front with respect to the plane of FIG. 13) deflects the electron beam 6 entering the vacuum tube 21 leftward with respect to the running direction thereof, whereby the electron beam 6 runs circumferentially along the vacuum tube 21*b*.

The vacuum tube 21 has coils 25 extending along the vacuum tube 21 as shown in FIGS. 14 through 18, to form a magnetic field for moving the electron beams 6 along the circular orbit. These coils 25 have a function equivalent to that of the ring-shaped electromagnets 13 in the first embodiment, and form a magnetic field uniformly in the circumferential direction of the vacuum tube 21. This magnetic field extends from front to back with respect to the plane of FIG. 13 (which is shown in broken lines in FIGS. 15 through 18). Consequently, the electron beams 6 deflected by the deflecting magnets 23 invariably are subjected to forces acting rightward with respect to the running direction thereof (i.e. toward the center of the ring-shaped vacuum tube 21). The electron beams 6 are thus caused to move along the circular orbit substantially coaxial with the ring-shaped vacuum tube 21 by adjusting a current flowing through the coils 25 to appropriately set intensity of this magnetic field.

Figure 17:
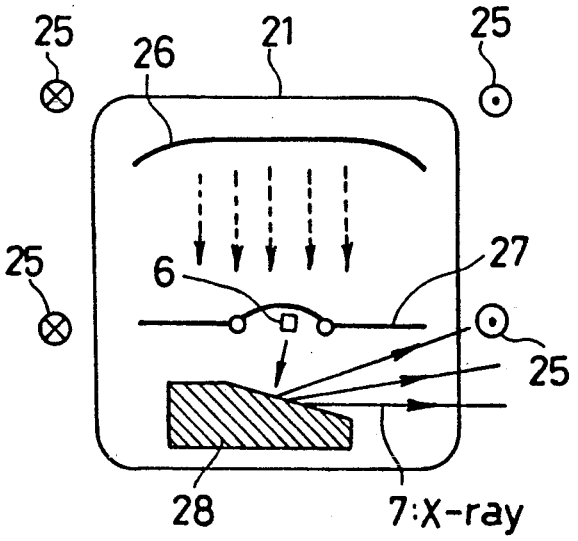
FIG. 17 is a section taken on line E—E of FIG. 13.
Figure 18:
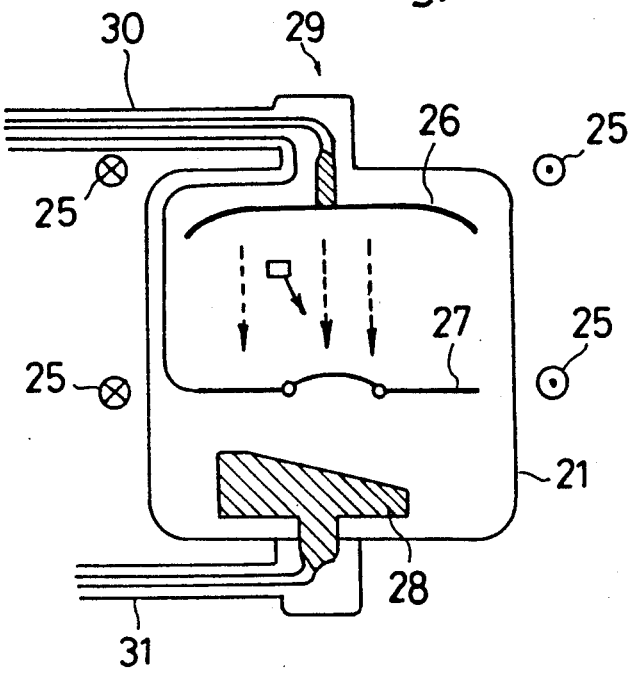
FIG. 18 is a section taken on line F—F of FIG. 13.
Figure 19:
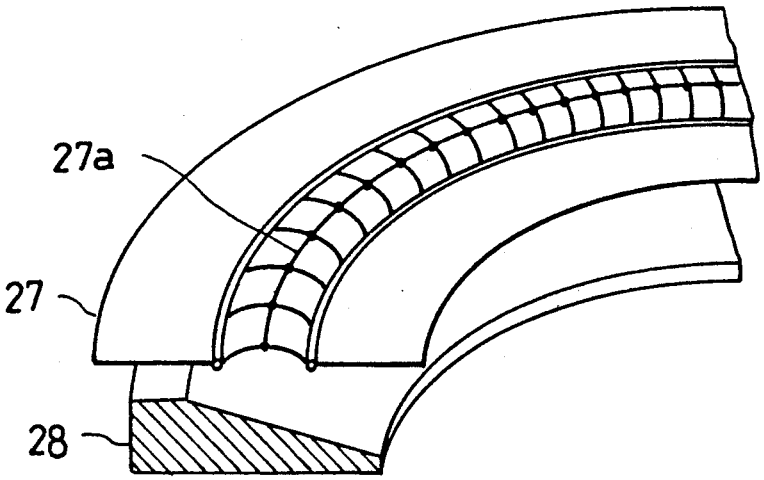
FIG. 19 is a fragmentary perspective view of a ring-shaped grid and a ring-shaped target.

As shown in FIGS. 14 through 18, the vacuum tube contains a ring-shaped fixed cathode 26, a ring-shaped grid 27 and a ring-shaped target 28 (see FIG. 19 also). The fixed cathode 26 and grid 27 correspond to the second deflecting device of this invention. These components are all formed substantially coaxially with the ring-shaped vacuum tube 21, and are arranged in a direction perpendicular to the plane formed by the vacuum tube 21, i.e. axially of the examinee M. As shown in FIG. 29, the grid 27 includes a mesh portion 27*a* in the center thereof. As shown in FIGS. 13 and 18, these electrodes 26, 27 and 28 are connected at a voltage supply position 29 to cables 30 and 31 for application of voltages.

Figure 20:
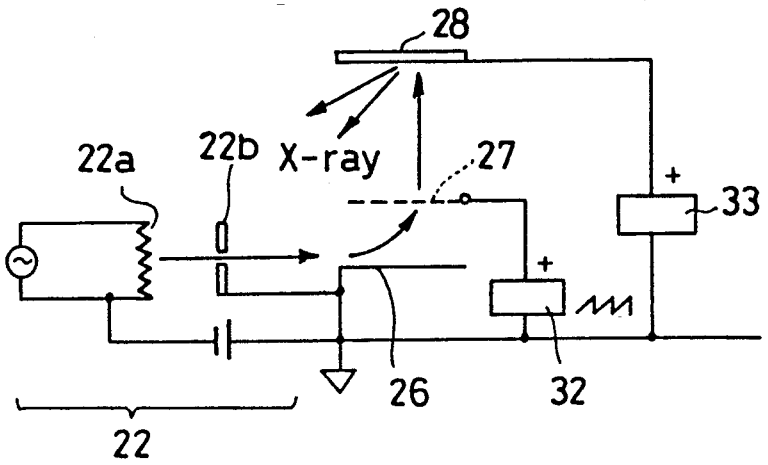
FIG. 20 is a view showing an electric connection structure of the apparatus in the third embodiment.

FIG. 20 shows electric connections for the fixed cathode 26, grid 27 and target 28, and the filament 22*a* and accelerating electrodes 22*b* of each electron gun 22. A sawtooth deflecting voltage source 32 is connected between the fixed cathode 26 and grid 27, and an electron orbit deflecting high voltage source 33 is connected between the fixed cathode 26 and target 28.

Figure 21:
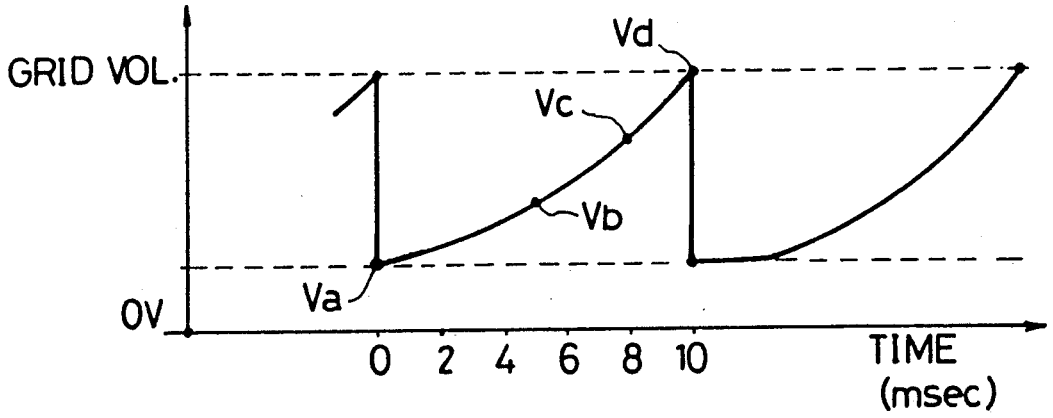
FIG. 21 is a view showing a waveform of voltage applied to the grid.

FIG. 21 shows a sawtooth deflecting voltage applied to the grid 27. When this grid voltage is high, the electron beam 6 emitted from each electron gun 22 and deflected by the deflecting magnets 23 to run through a space between the fixed cathode 26 and grid 27 is drawn toward the grid 27 by a strong electrostatic force. Consequently, the electron beam 6 impinges on the target 28 after passing through the grid 27 at an early stage, i.e. at a position close to the electron gun 22. On the other hand, when the grid voltage is low, only a weak electrostatic force is operative to draw the electron beam 6 toward the grid 27. Consequently, each electron beam 6 passes through the grid 27 at a position remote from the electron gun 22 to reach the target 28. When the electron beam 6 impinges on the target 28, as shown in FIG. 17, an X-ray 7 is generated at the position of impingement and travels therefrom toward the center of the ring-shaped vacuum tube 21, i.e. toward the examinee M.

This embodiment includes two electron guns 22 located 180 degrees apart from each other. Thus, the X-ray generating position may be moved through 360 degrees by causing the electron beam 6 emitted from each electron gun 22 to impinge on the target 28 through the 180 degree range. In the example shown in FIG. 13, the electron beam 6 emitted from the left electron gun 22 covers the upper right range from point a to point d, while the electron beam 6 emitted from the right electron gun 22 covers the lower left range from point d to point a. For this purpose, the grid voltage shown in FIG. 21 is at a maximum Va when the electron beam 6 emitted from the left electron gun 22 reaches the target 28 at point a, and the electron beam 6 emitted from the right electron gun 22 reaches the target 28 at point d. The grid voltage is at a minimum Vd when the electron beam 6 emitted from the left electron gun 22 reaches the target 28 at point d, and the electron beam 6 emitted from the right electron gun 22 reaches the target 28 at point a. When the grid voltage is at Vb, the electron beam 6 emitted from the left electron gun 22 reaches the target 28 at point b. When the grid voltage is at Vc, the electron beam 6 emitted from the left electron gun 22 reaches the target 28 at point c and the electron beam 6 emitted from the right electron gun 22 reaches the target 28 at point c'.

Figure 22:
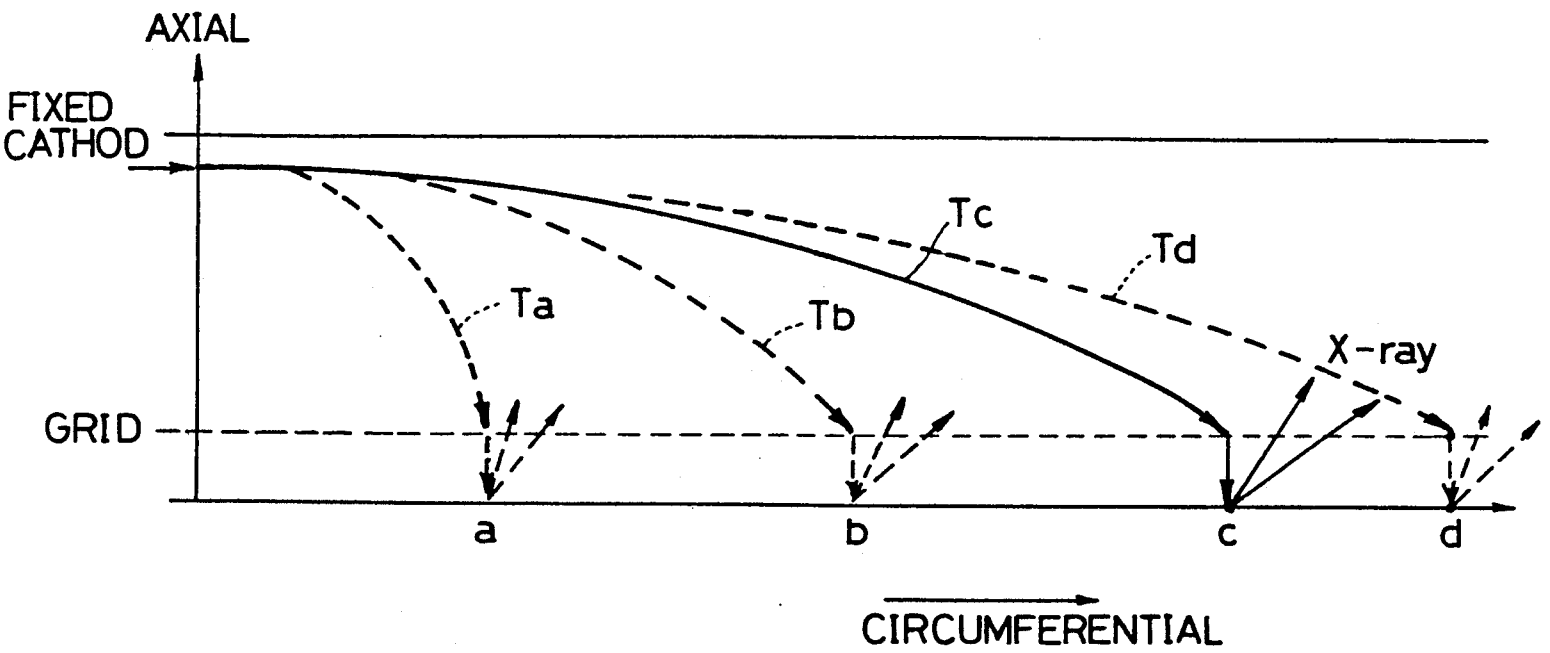
FIG. 22 is a view illustrating functions of the third embodiment.

FIGS. 22 shows tracks Ta, Tb, Tc and Td followed by the electron beam 6 emitted from the left electron gun 22 when the grid voltage is Va, Vb, Vc and Vd, respectively. In this graph, the horizontal axis represents the circumferential direction of the ring-shaped vacuum tube 21, and the vertical axis the axial direction of the vacuum tube 21 (i.e. the axial direction of the examinee M), that is positions at which the electron beam 6 travels from the fixed cathode 26 to the target 28. It will be seen that, by varying the grid voltage from Va to Vd, the electron beam 6 is caused to take varied tracks as shown in FIG. 22, thereby to move the X-ray generating position through the 180 degree range from point a to points b, c, and d. Where the sawtooth grid voltage has cycles of 10 msec, the X-ray generating position will complete a scan through the 180 degree range in 10 msec.

The foregoing positional relationship among the fixed cathode 26, grid 27 and target 28 in the ring-shaped vacuum tube 21 is illustrated by way of example only. These electrodes 26, 27 and 28 may be arranged radially of the vacuum tube 21 a in the first embodiment.

The number of electron guns 22 is not limited to two, but may be one, three or more. Electrons may be emitted from a plurality of electron guns simultaneously to generate X-rays at the corresponding number of positions simultaneously, or may be emitted with time lags.

The present invention may be embodied in other specific forms without departing from the spirit or essential attributes thereof and, accordingly, reference should be made to the appended claims, rather than to the foregoing specification, for determining the scope of the invention.

What is claimed is:

1. A high-speed scan type X-ray generating apparatus for scanning X-ray generating positions along a circumference of an examinee, said apparatus comprising;

a ring-shaped vacuum tube, at least one electron gun for emitting an accelerated electron beam into said vacuum tube, first deflecting means for causing said electron beam to run on a ring-shaped orbit through said vacuum tube, said first deflecting means including a pair of ring-shaped magnets oppose to each other across said vacuum tube for generating a magnetic field perpendicular to a plane formed by said ring-shaped vacuum tube;

second deflecting means for causing said electron beam to deviate from said ring-shaped orbit, said second deflecting means includes at least one pair of small electromagnets disposed in spaces between opposite pole faces of said ring-shaped magnets and said vacuum tube, for generating a magnetic field opposite to said magnetic field formed by said ring-shaped magnets, to cause said electron beam to deviate radially outwardly from said ring-shaped orbit; and a target for generating X-rays toward center of said vacuum tube when said electron beam deviating from said ring-shaped orbit by said second deflecting means, impinges thereon, said target being a ring-shaped target having an inside peripheral wall for generating the X-rays toward the center of said vacuum tube;

wherein opposite pole faces of the pair of ring-shaped magnets constituting said first deflecting means are inclined to diverge from each other toward the center of said ring-shaped vacuum tube.

2. A high-speed scan type X-ray generating apparatus for scanning X-ray generating positions along a circumference of an examinee, said apparatus comprising:

a ring-shaped vacuum tube;

at least one electron gun for emitting an accelerated electron beam into said vacuum tube;

first deflecting means for causing said electron beam to run on a ring-shaped orbit through said vacuum tube, said first deflecting means includes a pair of ring-shaped magnets opposed to each other across said vacuum tube for generating a magnetic field perpendicular to a plane formed by said ring-shaped vacuum tube;

second deflecting means for causing said electron beam to deviate from said ring-shaped orbit, said second deflecting means including at least one pair of small electromagnets opposed to one another across said radially of said vacuum tube for generating a magnetic field opposite to said magnetic field formed by said ring-shaped magnets, to cause said electron beam to deviate in a direction intersecting said plane formed by said vacuum tube; and a target for generating X-rays toward a center of said vacuum tube when said electron beam, after being deviated from said ring-shaped orbit to said second deflecting means, impinges thereon, said target is a ring-shaped target having a wedge-shaped section for generating the X-rays toward the center of said vacuum tube;

wherein opposite pole faces of the pair of ring-shaped magnets constituting said first deflecting means are inclined to diverge from each other toward the center of said ring-shaped vacuum tube.

3. An apparatus as claimed in claim 1 or 2, wherein said ring-shaped vacuum tube contains at least one accelerating electrode disposed along the base orbit for accelerating said electron beam, in addition to the accelerating electrodes for causing the electron beam emitted from the electron gun to enter the vacuum tube.

4. An apparatus as claimed in claims 1 or 2, wherein said opposite pole faces of said ring-shaped magnets define hills and valleys arranged in a direction of travel of said electron beam and opposed to one another.

5. An apparatus as claimed in claims 1 or 2, further comprising a plurality of magnets arranged between said opposite pole faces of said ring-shaped magnets and having polarities alternately reversed in a circumferential direction.

* * * * *